US008167984B1

(12) United States Patent
Rogers, Jr.

(10) Patent No.: US 8,167,984 B1
(45) Date of Patent: May 1, 2012

(54) MULTISTAGE ELECTRICALLY CHARGED AGGLOMERATION SYSTEM

(76) Inventor: Gilman H. Rogers, Jr., Hueytown, AL (US)

( * ) Notice: Subject to any disclaimer, the term of this patent is extended or adjusted under 35 U.S.C. 154(b) by 479 days.

(21) Appl. No.: 12/411,503

(22) Filed: Mar. 26, 2009

Related U.S. Application Data

(60) Provisional application No. 61/040,264, filed on Mar. 28, 2008.

(51) Int. Cl.
*B03C 3/08* (2006.01)
*B03C 3/09* (2006.01)

(52) U.S. Cl. ..... 96/30; 55/DIG. 39; 95/78; 96/54; 96/55; 96/66; 210/243

(58) Field of Classification Search ..... 96/30, 54, 96/55, 66, 67, 69, 77–79, 100; 55/DIG. 39; 95/78–80; 210/243, 748.01
See application file for complete search history.

(56) References Cited

U.S. PATENT DOCUMENTS 3,616,606 A * 11/1971 Vincent ..... 96/66
3,826,063 A 7/1974 Festner
3,973,932 A * 8/1976 Alskog ..... 96/67
4,038,049 A * 7/1977 Melcher et al. ..... 95/62
4,038,052 A * 7/1977 Melcher et al. ..... 96/77
4,734,105 A 3/1988 Eliasson et al.
4,765,803 A 8/1988 Hirth
5,824,137 A 10/1998 Gutsch et al.
5,993,521 A 11/1999 Loreth et al.
6,447,580 B1 * 9/2002 Ridgeway et al. ..... 96/30
6,589,314 B1 7/2003 Page et al.
6,758,884 B2 * 7/2004 Zhang et al. ..... 96/50
6,878,192 B2 * 4/2005 Pasic ..... 96/66
7,008,469 B2 * 3/2006 Vetter et al. ..... 96/67
7,258,729 B1 * 8/2007 Barsimanto et al. ..... 96/66
7,294,169 B2 * 11/2007 Taylor ..... 95/2
2007/0137480 A1 * 6/2007 Bergeron et al. ..... 95/79

* cited by examiner

*Primary Examiner* — Richard L Chiesa
(74) *Attorney, Agent, or Firm* — Gerald M. Walsh; Kenneth M. Bush; Bush Intellectual Property Law

(57) ABSTRACT

A system for the electrical agglomeration of particles in a fluid using a plurality of electrically charged panels, such as electrets, metal panels, or any conductive material, positioned in series perpendicular to the direction of flow of fluid. The panels are about 20% to 80% open to the flow of fluid. The panels produce agglomerates of increasing size and number from the particles in a fluid as the fluid flows through each of the panels. The panels have an electrical charge of about 5,000 to 12,000 volts with amperage about 0.001 amps to 100 amps. Agglomerates are trapped by downstream capture media.

12 Claims, 2 Drawing Sheets

MULTISTAGE ELECTRICALLY CHARGED AGGLOMERATION SYSTEM

CROSS-REFERENCE TO RELATED APPLICATION

This application claims the benefit of U.S. Provisional Application No. 61/040,264, filed Mar. 28, 2008, which is incorporated herein by reference.

BACKGROUND OF THE INVENTION

1. Field of the Invention

The present invention relates to fluid filtering systems and, more particularly, to fluid filtering systems that produce agglomeration of particles in the fluid by means of a plurality of electrically charged panels such as electrets, metals, conductive materials or electrically charged materials.

2. Technical Background

Efforts have been made to create electrically charged dust filters to capture particles because of the associated high initial efficiencies. Such devices, commonly referred to as electrical precipitators, use pairs of charged plates of opposing charges, each creating a separate zone of influence over the passing particles. The first zone has the purpose of imparting a charge in the fluid by means of ionizing the fluid with the use of grids, panels, or plates that are electrically charged. The particle being transported through this zone by the fluid becomes charged. A second plate or grid downstream creates a capture zone. It is charged with an opposing charge. This opposing charge attracts the particles and causes them to attach to the capture plates or grids. This deposition and accumulation of particles on the plates produces unacceptable maintenance problems associated with a rapid drop in efficiency of the filtering process as the capture plate gets dirty. Furthermore, present day electrically charged filter systems have limited use because plate cleaning systems, other than manual methods, are generally expensive and subject to high maintenance costs, requiring an inordinate amount of cleaning to maintain claimed efficiencies. These electrically charged filter systems have a complicated expensive construction due to the design and expected reliability of operation.

It is known that certain materials can be permanently electrically charged, such as by heating the material, applying a high-voltage electrical field, and cooling the material while under the influence of the electrical field. These materials form an electret when the rate of decay of the field-induced polarization can be slowed down so much that a significant fraction of the electrical charge is preserved long after the polarizing field has been removed. Such electrets with a sustained or permanent electrical charge can be made by various methods, e.g. corona charging, triboelectrical charging (friction) and so forth. To improve the charge within an electret, various topical treatments have been used as a means to improve the stability of such charges. In addition, electret non-woven webs of non-polar polymeric materials have been provided which introduce polar groups onto side-chains and/or the backbone of the non-polar monomer or otherwise grafting unsaturated carboxylic acids thereon. Such electret materials have been used to form filters to trap particles in the air or other fluids.

The use of electret devices to produce agglomeration of particles in a fluid would greatly improve the process of electrical filtration by providing a safe and inexpensive means of removing particles from air and other fluids. However, such devices have heretofore been unknown.

SUMMARY OF THE INVENTION

The present invention is a system for electrical agglomeration of particles in a fluid. The system includes a plurality of panels positioned in series perpendicular to the direction of flow of fluid (gas or liquid), with the panels being spaced apart. Each of the panels has an electrical charge, and panels are about 20% to 80% open to the flow of fluid. These panels create electrically charged zones for particulate agglomeration, producing agglomerates of increasing size and number from the particles in a fluid as the fluid flows through each of the panels. The panels have an electrical charge of about 5,000 to 12,000 volts with amperage about 0.001 amps to 100 amps. The front and back sides of the panel can have the same electrical charge or opposite electrical charges. The panel can be an electret with a permanent or sustained electrical charge, or a metal panel, or any conductive material, with an applied electrical charge, or a combination thereof. One or more capture media are positioned downstream from one or more panels to capture agglomerates that form as the fluid flows through the plurality of panels. Each panel has its own electrical charging zone, depending upon the degree of voltage and/or amperage within or applied to the panel. The panels can be arranged to have equal charging zones, increasing charging zones, or decreasing charging zones, or a combination thereof, with regard to the direction of flow.

An advantage of the present invention is a filtering system that produces a progressive agglomeration of particulates by thoroughly imparting an electrical charge to all of the particulates in the fluid stream while creating progressively larger particles (agglomerates) through agglomeration. Combined with particulate agglomeration, even lower efficiency, lower pressure drop filter media produce high collection efficiencies at considerably lower costs, compared to systems that do not produce agglomeration.

Another advantage is removal of agglomerated particles from panels having an applied electrical charge by reversing the electrical polarity of the panels.

Another advantage is a filtering system that maintains high efficiency, with minimal maintenance and reduced system energy costs. The system resistance to airflow is minimal.

DETAILED DESCRIPTION OF THE INVENTION

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

Figure 1:
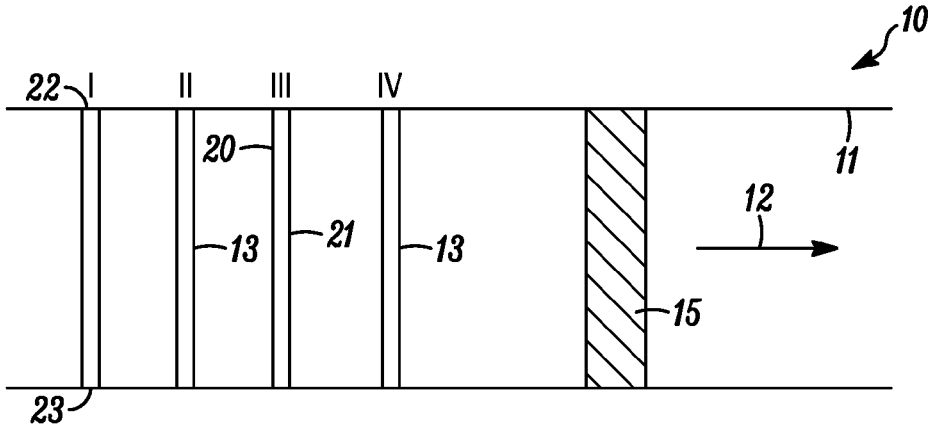
FIG. 1 illustrates a side view of electrically charged panels of the present invention arranged in series upstream from a capturing medium.
Figure 2:
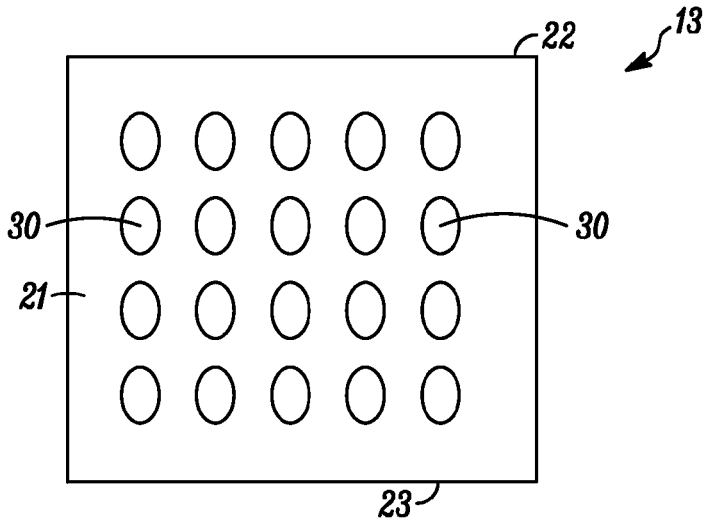
FIG. 2 illustrates a front view of the electrically charged panel.

FIG. 1 shows a cross-section illustration of the multistage electrical agglomeration system 10 of the present invention. The system 10 is contained within a housing 11 suitable for conducting the flow of air or other fluids (liquid or gas). The direction of air flow is shown by arrow 12. A plurality of electrically charged panels 13 are placed within housing 11. The panels 13 are arranged in vertical stages, such as I, II, III, IV, V, etc. The panels 13 are spaced apart and oriented perpendicular to the flow of fluid. FIG. 2 shows a front view of panel 13. Panel 13 has a top 22 and a bottom 23, and has perforations or openings 30 so that about 20% to 80%, of the panel 13 is open to allow air or fluid flow through the panel 13. The panels 13 have a first side 20 and an opposite second side 21.

The panels 13 are electrically charged on both sides 20 and 21. The charges can be the same on each side or positive on one side and negative on the other. The panels 13 can have an electrical charge of about 5,000 to 12,000 volts, with about 0.001 amps to 100 amps. The panels 13 can consist of electrets having a sustained electrical charge within the electret, or can be metal panels, or any conductive material, with a continuously applied electrical charge, or a combination thereof. For example, one side of a plastic electret panel can be made of metal or conductive material to which an electrical charge is applied.

As air or other fluids pass through the perforations 30 in the various stages of panels 13, particles in the fluid will become electrically charged by the electrical charges on panels 13. The particles will start to agglomerate because of the electrical charges they acquired by passing through panels 13. As fluid flow continues through each of the stages of panels 13, more agglomeration of particles in the fluid will occur. The agglomerates will increase in size and number with each successive passage through a stage. Each panel can have its own electrical charging zone, depending upon the degree of voltage and/or amperage within or applied to the panel. The panels can be arranged to create equal charging zones, increasing charging zones, or decreasing charging zones, or a combination thereof, with regard to the direction of flow.

Downstream from the plurality of stages of panels 13 is a capturing media 15. Capturing media 15 will trap and hold the agglomerates, removing them from the fluids as the fluids pass through the capturing media 15. Any type of mechanical filter known in the art may be used as a capturing media including those composed of woven or non-woven fibers. Adsorption media known in the art may be used, including those composed of carbon or permanganate. Adsorption media can capture various types of agglomerates, including those composed of formaldehyde. Adsorption media containing hydrated chemicals can be used, and can trap various types of agglomerates, including those composed of hydrogen sulfide. Mechanical, adsorption, or absorption media may be neutral with regard to electrical charge. Charged capturing media may also be used, such as, for example, an electret filter media. Capturing media 15 may be replaceable and disposable or cleanable and reusable.

Figure 3:
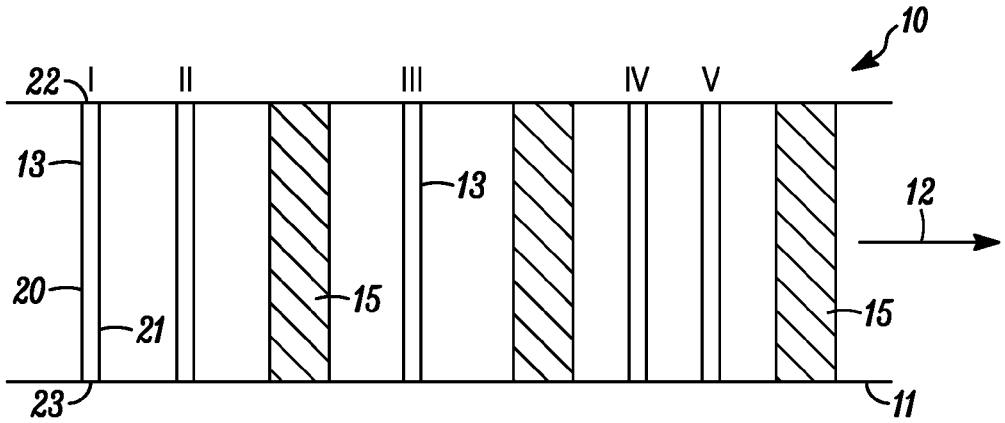
FIG. 3 illustrates an alternate arrangement of electrically charged panels and capturing media.

FIG. 3 shows an alternate arrangement of panels 13, stages, and capturing media 15. A plurality of capturing media 15 may be interspersed among the stages I-V. In any case, there should be at least one panel 13 upstream from a capturing media 15.

Figure 4:
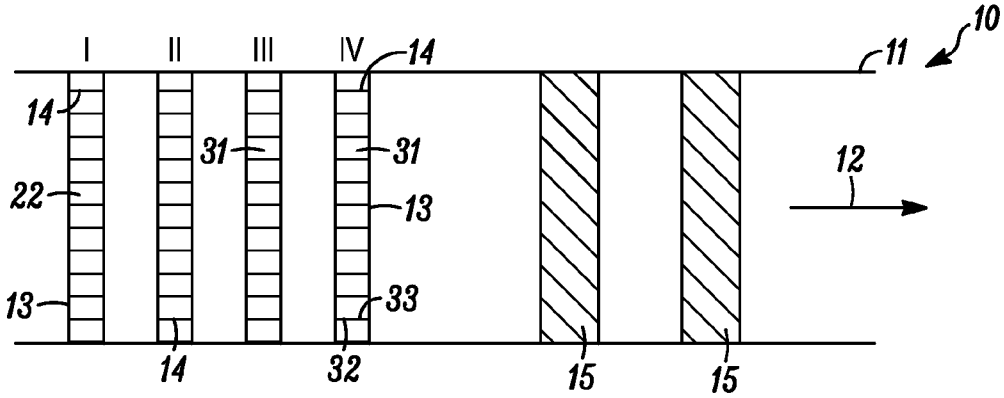
FIG. 4 illustrates a top view of an alternate embodiment of electrically charged panels.
Figure 5:
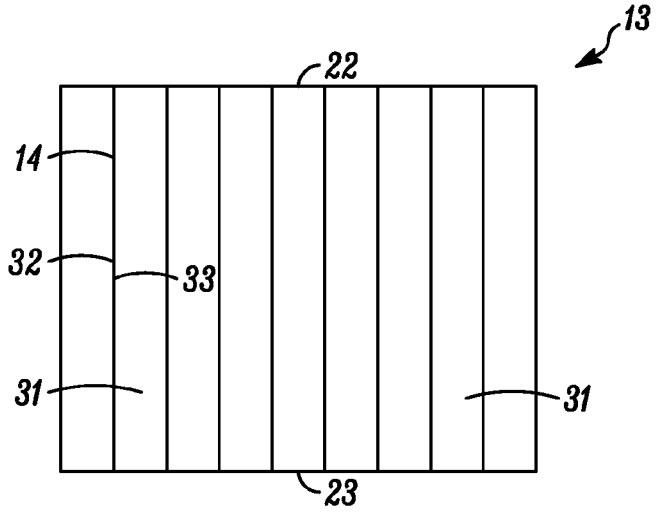
FIG. 5 illustrates a front view of the alternate embodiment of an electrically charged panel.

FIG. 4 shows a top view of an alternate embodiment of the multistage electrical agglomeration system 10 of the present invention. In this embodiment, a plurality of electrically charged plates 14 are oriented parallel to the direction of fluid flow 12. The plates 14 are also positioned parallel to each other to form a vertical panel 13, to form stages I-IV. Air or other fluids flow over and around each parallel oriented plate 14 as fluid flows through the panel 13. The construction of each plate 14 and the number of them in each panel 13 is such that about 20% to 80% of each panel 13 is open to fluid flow. The panels 13 are spaced apart and oriented perpendicular to the flow of fluid. FIG. 5 shows a front view of panel 13. Panel 13 has a top 22 and a bottom 23, and has open spaces 31 between each plate 14. The plate 14 has a first side 32 and a second opposite side 33. The plates 14 are electrically charged on both sides 32 and 33. The charges can be the same on each side or positive on one side and negative on the other. The plates 14 can have an electrical charge of about 5,000 to 12,000 volts, with about 0.001 amps to 100 amps. The plates 14 can consist of plastic electrets having a sustained static electrical charge within the electret, or can be metal plates, or any conductive material, with a continuously applied electrical charge, or a combination thereof. For example, one side of a plastic electret plate 14 can be made of metal or conductive material to which an electrical charge is applied.

As air or other fluids pass through the open spaces 30 in the various stages of panels 13, particles in the fluid will become electrically charged by the electrical charges on plates 14. The particles will start to agglomerate because of the electrical charges they acquired by passing over and around plates 14. As fluid flow continues through each of the stages of panels 13, more agglomeration of particles in the fluid will occur. The agglomerates will increase in size and number with each successive passage through a stage. Each plate and panel can have its own electrical charging zone, depending upon the degree of voltage and/or amperage within or applied to the plate. The panels can be arranged to create equal charging zones, increasing charging zones, or decreasing charging zones, or a combination thereof, with regard to the direction of flow. Downstream from the plurality of stages of panels 13 is a capturing media 15. Capturing media 15 will trap and hold the agglomerates, removing them from the fluids as the fluids pass through the capturing media 15.

Figure 6:
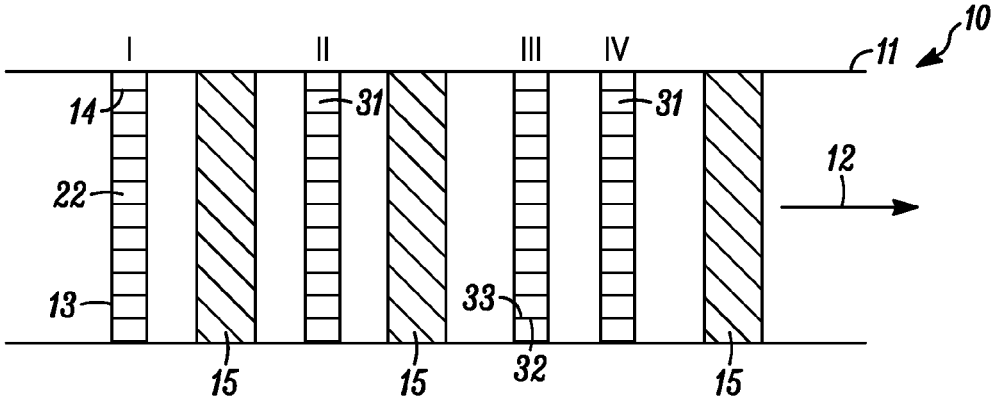
FIG. 6 illustrates an alternate arrangement of the alternate embodiment of electrically charged panels and capturing media.

FIG. 6 shows the alternate arrangement of panels 13, stages, and capturing media 15, similar to that shown in FIG. 3.

In cases where metal or electrically conductive panels or plates are used, or where electret panels or plates with metal on one side are used, electrical charges on the panels or plates are provided by an electrical power source by methods well known in the art. An electronic switch can be used to reverse the electrical polarity of these panels or plates manually, as desired, or automatically using a timer device. When the polarity is reversed, any agglomerates that have precipitated on the panels or plates will be repelled by the panels or plates. As a result the agglomerates will become airborne and become trapped in the capture media down stream. In this manner the metal panels or plates can be kept cleaned.

The foregoing description has been limited to specific embodiments of this invention. It will be apparent; however, that variations and modifications may be made by those skilled in the art to the disclosed embodiments of the invention, with the attainment of some of all of its advantages and without departing from the spirit and scope of the present invention. For example, a filtering system of any desired size can be constructed using the multistage electrically charged agglomeration system of the present invention. Charged electret panels or plates of any desired shape and size can be constructed from any suitable materials known in the art. Any suitable forms of capture media known in the art can be used. Any suitable types of fans and motors may be used.

It will be understood that various changes in the details, materials, and arrangements of the parts which have been described and illustrated above in order to explain the nature of this invention may be made by those skilled in the art without departing from the principle and scope of the invention as recited in the following claims

The invention claimed is:

1. A system for electrical agglomeration of particles in a fluid, comprising:

a) a plurality of panels positioned in series perpendicular to the direction of flow of fluid;

b) said panels being spaced apart;

c) each of said panels having an electrical charge;

d) each of said panels being about 20% to 80% open to the flow of fluid; and e) each of said panels producing agglomerates of increasing size and number from the particles in a fluid as the fluid flows through each of said panels, wherein said panels have an electrical charge of about 5,000 to 12,000 volts with about 0.001 amps to 100 amps.

2. The system of claim 1 wherein each panel has a first side and a second opposite side, said first side and said second opposite side having the same electrical charge or opposite electrical charges.

3. The system of claim 1 wherein said panel is an electret with a permanent electrical charge within, or is a metal panel, or any conductive material, with an applied electrical charge, or is a combination thereof.

4. The system of claim 3 wherein said metal panel, or any conductive material, can be cleaned of agglomerated particles by reversal of the polarity of said metal panel or conductive material.

5. The system of claim 3 wherein each panel has its own charging zone, depending upon the degree of voltage and/or amperage within or applied to the panel, and said panels are arranged to create equal charging zones, increasing charging zones, or decreasing charging zones, or a combination thereof, with regard to the direction of flow of fluid.

6. The system of claim 5 wherein one or more capture media are positioned downstream from one or more said panels, relative to the direction of flow of fluid, to capture agglomerates.

7. A system for electrical agglomeration of particles in a fluid, comprising:

a) a plurality of panels positioned in series perpendicular to the direction of flow of fluid;

b) said panels being spaced apart;

c) said panels consisting of plates positioned parallel to the direction of fluid flow;

d) each of said plates having an electrical charge;

e) each of said plates constructed so that each of said panels are about 20% to 80% open to the flow of fluid; and f) each of said plates producing agglomerates of increasing size and number from the particles in a fluid as the fluid flows over and around each plate and through each of said panels, wherein said plates have an electrical charge of about 5,000 to 12,000 volts with about 0.001 amps to 100 amps.

8. The system of claim 7 wherein each plate has a first side and a second opposite side, said first side and said second opposite side having the same electrical charge or opposite electrical charges.

9. The system of claim 8 wherein said plate is an electret with a permanent static electrical charge within, or is a metal plate or, any conductive material, with an applied electrical charge, or is a combination thereof.

10. The system of claim 9 wherein said metal plate, or any conductive material, can be cleaned of agglomerated particles by reversal of the polarity of said metal plate or conductive material.

11. The system of claim 9 wherein each plate has its own charging zone, depending upon the degree of voltage and/or amperage within or applied to the panel, and said panels are arranged to create equal charging zones, increasing charging zones, or decreasing charging zones, or a combination thereof, with regard to the direction of flow of fluid.

12. The system of claim 11 wherein one or more capture media are positioned downstream from one or more said panels, relative to the direction of flow of fluid, to capture agglomerates.

* * * * *